US006006521A

United States Patent [19]

Fuchita et al.

[11] Patent Number: 6,006,521

[45] Date of Patent: Dec. 28, 1999

[54] CONTROL CIRCUIT FOR HEAVY MACHINERY

[75] Inventors: Seiichi Fuchita, Katano; Tomio Teranaka, Yawata; Fujitoshi Takamura; Harushige Nishida, both of Hirakata; Kiyokazu Nakabo, Kyoto, all of Japan

[73] Assignee: Komatsu Ltd., Tokyo, Japan

[21] Appl. No.: 09/139,930

[22] Filed: Aug. 26, 1998

[30] Foreign Application Priority Data

Aug. 28, 1997 [JP] Japan ..... 9-246001

[51] Int. Cl.[6] ..... F15B 11/16

[52] U.S. Cl. ..... 60/422; 60/426

[58] Field of Search ..... 60/422, 426; 91/513

[56] References Cited

U.S. PATENT DOCUMENTS

| | | | |
|---|---|---|---|
| 5,201,177 | 4/1993 | Kim | 91/513 |
| 5,251,444 | 10/1993 | Ochiai et al. | 60/426 |
| 5,520,087 | 5/1996 | Takamura et al. | 60/422 |

FOREIGN PATENT DOCUMENTS

| | | |
|---|---|---|
| 1-250531 | 10/1989 | Japan . |
| 8-93000 | 4/1996 | Japan . |

*Primary Examiner*—F. Daniel Lopez
*Attorney, Agent, or Firm*—Sidley & Austin

[57] ABSTRACT

A control circuit for a piece of heavy machinery reduces a speed of one actuator, having a lower load, when that actuator and another actuator, having a higher load, are operated simultaneously. The control circuit includes a first control valve for supplying a first actuator with pressurized oil, discharged from a hydraulic pump; a second control valve for supplying a second actuator with pressurized oil, discharged from the hydraulic pump; operating units for actuating the first control valve and the second control valve; and a mode selector for providing a command to the second control valve in order to increase a speed of the first actuator compared with that of the second actuator when the first and second actuators are operated simultaneously. A variable adjustor can be provided to control the open area of a valve for enabling the stroke of the spool of the second control valve to regulated. The control circuit can include a sensor for detecting pilot pressure applied to the first control valve; a sensor for detecting pilot pressure applied to either end of the second control valve; a solenoid valve for passing pilot pressure to pilot ports at both ends of the second control valve; and a controller for actuating said solenoid valve responsive to signals from the two sensors.

5 Claims, 8 Drawing Sheets

CONTROL CIRCUIT FOR HEAVY MACHINERY

FIELD OF THE INVENTION

This invention relates to a control circuit for a machine having a plurality of hydraulic actuators, e.g., a construction vehicle such as a hydraulic shovel, and more particularly to a control circuit for controlling the operation speeds of a boom actuator and an upper vehicle turning actuator of a construction vehicle when these actuators are simultaneously operated.

BACKGROUND OF THE INVENTION

A hydraulic shovel 100 will be described with reference to FIG. 5 of the accompanying drawings. A lower caterpillar tractor 21 (called "traveling undercarriage") is movable back and forth by a driving motor 24. An upper revolvable member 23 (called "upper revolvable turret", "upper vehicle", or "main vehicle") is mounted on the caterpillar tractor 21 via a turntable 22, and is turned about the vertical axis of the turntable 22 by a turning motor 25. The upper vehicle 23 comprises an excavating machine 30, a machine cab 26, an operator cabin 27, and a counterweight 28.

The excavating machine 30 includes a boom 31, a digging arm 33, a bucket 35, a boom actuator 32, an arm actuator 34, and a bucket actuator 36. One end of the boom 31 is pivotally attached to a bracket (not shown), fixed to the upper vehicle 23, and is movable vertically in response to the operation of the boom actuator 32. One end of the digging arm 33 is pivotally attached to the distal end of the boom 31 and is movable vertically in response to the operation of the arm actuator 34. The bucket is pivotally attached to the lower (distal) end of the digging arm 33 and is pivoted in response to the operation of the bucket actuator 36.

The motors 24 and 25 and the actuators 32, 34, and 36 are operated independently of each other or in various combinations with each other by a control circuit (not shown) in order to perform excavation. At the present time, there is a strong demand for a control circuit which can more efficiently control the combined operations of the foregoing members.

Japanese Patent Laid-Open Publication 1-250531 exemplifies a device for improving the efficiency of combined operations of an excavating machine. The device will be described referring to FIG. 6. When the pilot valve 50 is operated in the direction U in order to contract the arm actuator 55, a pilot pressure is applied to the pilot conduit 50A. In this state, if the pilot valve 51 has also been operated in the direction U in order to contract the boom actuator 56, a pilot pressure is introduced from the pilot valve 51 to the pilot port 52A of the selector valve 52, so that the selector valve 52 is switched over from its position a to its position b. The pilot pressure from pilot valve 51 is also applied to a control port of control valve 58, which controls the boom actuator 56.

The pilot circuit is formed by the selector valve 52 and the reducing valve 53. The pilot pressure applied via the pilot conduit 50A to the reducing valve 53 is reduced to a predetermined pressure by the reducing valve 53, and the reduced pressure acts on the control valve 57. If both the pilot valves 50 and 51 are operated to an equal extent, the pilot pressure in the pilot conduit 50A downstream of the reducing valve 53 is lower than the pilot pressure in the pilot conduit 51A. Therefore, an open area of the spool of the control valve 57 is smaller than an open area of the control valve 58.

As a result, an increased amount of pressurized oil flows to the control valve 58 via the conduit 54, so that the difference between the amount of pressurized oil applied to the arm actuator 55 and the amount of pressurized oil applied to the boom actuator 56 becomes smaller. Therefore, both the actuators 55 and 56 are contracted at substantially equal speeds, which means that they operate simultaneously at equal speeds.

There is another related art, e.g., Japanese Patent Laid-Open Publication No. 8-93000. This device of that publication will be described with reference to FIGS. 7 and 8. When the driving motor 24 and the arm actuator 34 are operated in combination, e.g., when the shift lever 48 is set to the forward position, the reducing valve 48*b* of the driving pilot valve 48*a* is activated. The pilot pressure for switching the driving control valve 42 from its neutral position a over to its position b acts not only on the operation part 42*b* of the driving control valve 42 but also on the operation part 45*b* of the arm control valve 45 via the shuttle valve 43 and the branch pilot conduit 41*a*. Therefore, the piston 47 in the arm control valve 45 is moved to the predetermined extent L in the arrow direction as shown in FIG. 8.

It is assumed here that the reducing valve 49*b* of the arm pilot valve 49*a* is operated with the arm operating lever 49 set to the excavation position in order to change the arm control valve 45 over to its position a from its neutral position n, and that the pilot pressure from the reducing valve 49*b* is applied to the operation part 45*a* of the arm control valve 45 via the pilot conduit 44*a*. The spool 46 (FIG. 8) of the arm control valve 45 is controlled so as not to operate with the full stroke, which reduces the open area of the spool 46. This is because the piston 47 has already been shifted by the predetermined extent L in the arrow direction as shown in FIG. 8. Therefore, the amount of pressurized oil applied to the arm actuator 34 is reduced, thereby enabling the operating speed of the traveling motor 24 and that of the arm actuator 34 to be matched.

However, there is a problem in that the operating speeds of the two actuators are not matched when they are operated in combination in order to cause the hydraulic shovel to do various jobs. This is because more pressurized oil tends to flow from a hydraulic pump to the actuator having a lower load. This problem is remarkable when a boom of the hydraulic shovel is moved and the upper vehicle is turned (so-called "hoist and turn") at the same time, a combination which is frequently performed during the operation of the hydraulic shovel. In such a case, the actuator for turning the upper vehicle has a lower load than that of the actuator for vertically moving the boom.

During the combined operation of the boom lifting and the upper vehicle turning, a larger amount of pressurized oil is supplied from the hydraulic pump to the actuator having the lower load, so that the upper vehicle is turned at an increased speed while the boom is moved at a reduced speed, i.e., the operation speed of the boom does not match the operation speed of the turning of the upper vehicle. This is because the two actuators are connected to the control circuit in parallel. In order to overcome this problem, the operator has to adjust an operation stroke of the turning lever in order to reduce the flow of pressurized oil from the hydraulic pump to the turn actuator, and to reduce the open area of the spool of the turn control valve so that the operation speeds of the two actuators can be matched. Thus, the operator is required to adjust the operation extent of the turn lever as well as performing the combined operation of the boom and the upper vehicle, which is complicated and troublesome.

In the pilot operation circuit described in Japanese Patent Laid-Open Publication No. 1-250531, the actuators 55 and 56 are usually operated at substantially the same speed during the combined operation, which is a rather slow speed. Further, there is another problem in that the open area of the spool of the arm control valve 57 is continuously regulated during the combined operation, and this regulation cannot be cancelled.

The pilot operation circuit of Japanese Patent Laid-Open Publication No. 8-93000 is effective for combined operations of the arm and the upper vehicle on an uphill gradient. However, the open area of the spool of the arm control valve is continuously regulated, and this regulation cannot be cancelled.

Both of the foregoing related arts are rather difficult to apply to the combined operations of the boom and the upper vehicle when excavated soil has to be quickly loaded onto a dump truck by operating the hydraulic shovel and turning the upper vehicle at the same time.

SUMMARY OF THE INVENTION

Paying attention to the foregoing problems of the related art, the present invention is intended to provide a control circuit for a machine having a plurality of hydraulic actuators, e.g., a piece of heavy machinery, in which one actuator having a low load is operated at a reduced speed in order to match its operating speed with that of another actuator having a higher load, and to improve the combined operations of these two actuators having different loads.

According to a first aspect of the invention, a control circuit for heavy machinery comprises: a first control valve for supplying a first actuator with pressurized oil discharged from a hydraulic pump; a second control valve for supplying a second actuator with pressurized oil discharged from a hydraulic pump; operating means for receiving a pilot pressure from a pilot pump and for actuating the first control valve and the second control valve. The control circuit further includes mode selecting means for providing the second control valve with a command to operate the first actuator at a speed which is higher than that of the second actuator when the first actuator and the second actuator are operated simultaneously in a combination of operations.

When the first and second actuators are simultaneously operated in the prior art and the first actuator (e.g., a boom actuator) receives a high load compared with the second actuator (e.g., a turn actuator), the second actuator operates at an increased speed compared with that of the first actuator. In other words, these actuators cannot operate at matched speeds. Therefore, an operator has to control an operation extent of an operation lever in order to decelerate the second actuator, which is very troublesome. However, in the present invention, the mode selector is operated in order to decelerate the second actuator, so that both the first and second actuators operate at matched speeds. This is effective in enhancing the combined operations of the actuators whose loads are different, and is useful for heavy machinery performing a variety of jobs.

The first actuator can be a hydraulic cylinder for operating a boom, and the second actuator can be a hydraulic motor for turning the upper vehicle.

Up to now, heavy machinery, such as a construction vehicle, has been most frequently used in combination with a dump truck. In such a case, when the boom is raised and the upper vehicle is turned at the same time, a higher load is necessary to raise the boom than that for turning the upper vehicle. In other words, the upper vehicle is turned at an increased speed compared with that for raising the boom. There is a problem in that the boom raising may not have been completed by the time the upper vehicle has been turned to its desired position, and in that the combined operation is not carried out at matched speeds. In accordance with the invention, the actuator for raising the boom is operated faster than the actuator for turning the upper vehicle, thereby enhancing the combined hoist and turn operation at matched speeds. Therefore, the invention is useful for the heavy machinery applied to various jobs, since the boom and turn actuators are operated in combination at the matched speeds.

The mode selector can include a solenoid valve connected to operation parts of the second control valve, a mode selecting switch, and a controller for issuing a command signal for setting the solenoid valve to an open position or a closed position in response to a signal from the mode selecting switch.

In the foregoing arrangement, the solenoid valve is set to the open position in response to the signal selected by the mode selector so that a pilot pressure is caused to act on the operation part of the second control valve, and the stroke of the spool of the second control valve is then regulated. An open area of the spool is reduced, the amount of pressurized oil is reduced, and the second actuator is operated at a reduced speed. This improves the combined operations of the first and second actuators.

The control circuit can further include a variable adjuster for variably regulating the stroke of the spool of the second control valve. The controller can regulate the open area of the solenoid valve in response to a signal from the variable adjuster. When the first and second actuators are operated in combination, the stroke of the spool is reduced, thereby operating the second actuator at a reduced speed compared with that of the first actuator.

The open area of the solenoid valve is regulated by the variable adjuster, so that the pilot pressure applied to the operation part of the second control valve is made variable, which is effective in regulating the stroke of the spool of the second control valve, and in enhancing the combined operations of the first and second actuators.

According to the first aspect, the control circuit can include regulating means, which has a solenoid valve connected to operation parts of the second control valve, a variable adjuster for variably regulating a stroke of a spool of the second control valve, and a controller for controlling an open area of the solenoid valve in response to a signal from the variable adjuster.

In this arrangement, the stroke of the spool is regulated to improve the combined operations of the first and second actuators.

In accordance with a second aspect of the invention, a control circuit for a piece of heavy machinery comprises: a first control valve for supplying a first actuator with pressurized oil, discharged from a hydraulic pump; a second control valve for supplying a second actuator with pressurized oil, discharged from the hydraulic pump; operating means for receiving a pilot pressure from a pilot pump and for actuating the first control valve and the second control valve; first detecting means for detecting a pilot pressure for switching the first control valve; second detecting means for detecting a pilot pressure for switching the second control valve; a solenoid valve, connected to operation parts of the second control valve; and a controller for providing the solenoid valve with a command to reduce a stroke of the spool of the second control valve in response to signals from both the first and second detecting means.

With the foregoing arrangement, when the first and second actuators are operated in combination, pilot pressures are generated in the pilot conduits of the first and second control valves. Receiving these pilot pressures, the controller controls the solenoid valve in order to regulate the stroke of the spool of the second control valve, which automatically improves the combined operation of the first and second actuators.

The operating parts of the second control valve can include: a pilot case, provided with first pilot ports, for receiving the pilot pressure for actuating the first control valve, and second pilot ports, for receiving the pilot pressure for actuating the second control valve; and a piston, housed in the pilot case, and being in contact with an end of the spool. The piston is pushed by the pilot pressure from the first control valve to regulate the stroke of the spool when the first and second actuators are operated in combination.

In this arrangement, the piston is moved in order to regulate the stroke of the spool of the second control valve. This is effective in simplifying the control circuit and in reducing the cost thereof.

The control circuit can further include a cancelling unit for cancelling the stroke regulation of the spool which would otherwise be executed during the combined operations of the first and second actuators.

No stroke regulation of the spool of the second control valve is necessary for simply turning the upper vehicle, or for simultaneously operating the boom and the arm, or the arm and the bucket. Stroke regulation is only required for the combined operation of the turning of the upper vehicle and the raising of the boom. In such a case, the cancelling unit can be operated to cancel the stroke regulation when it is not required. Cancellation of the stroke regulation enables the operator to easily operate the heavy machinery.

DETAILED DESCRIPTION OF THE PREFERRED EMBODIMENTS

The control circuit of the invention will be described in detail with reference to preferred embodiments shown in FIGS. 1–4.

Figure 1:
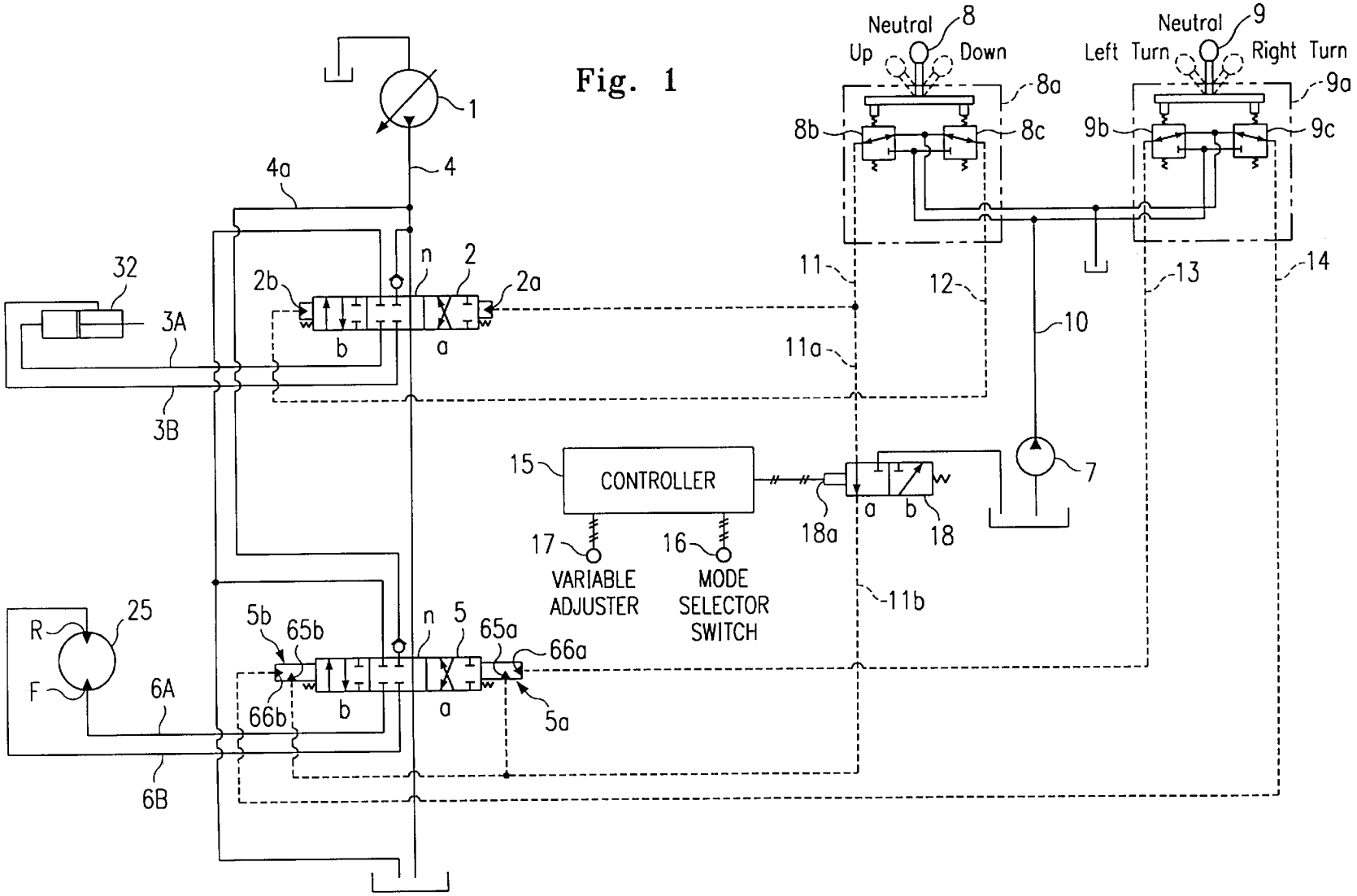
FIG. 1 shows a control circuit for a piece of heavy machinery, according to a first embodiment of the invention.
Figure 2:
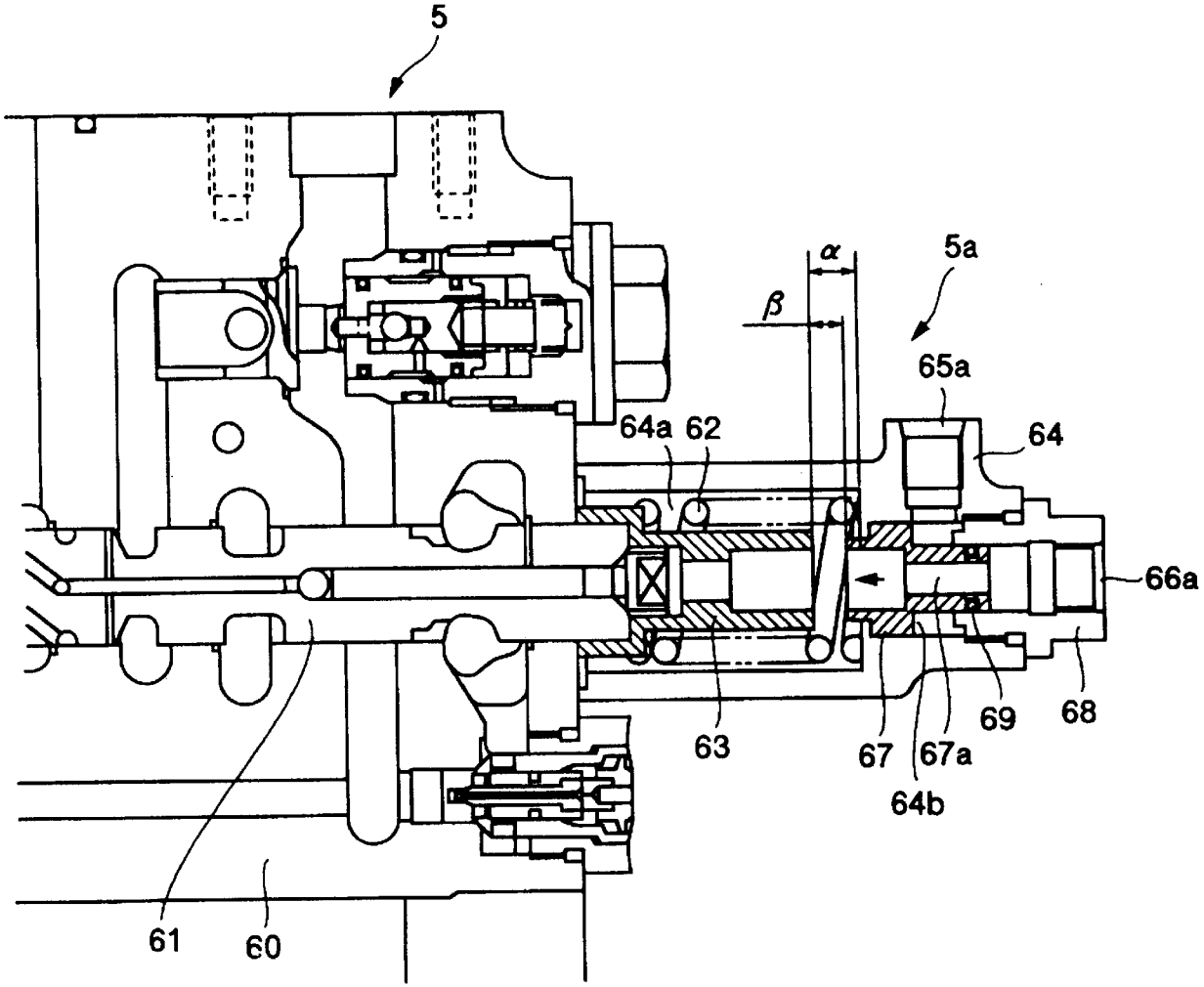
FIG. 2 shows in detail an operation part of a first control valve of the control circuit of FIG. 1.
Figure 3:
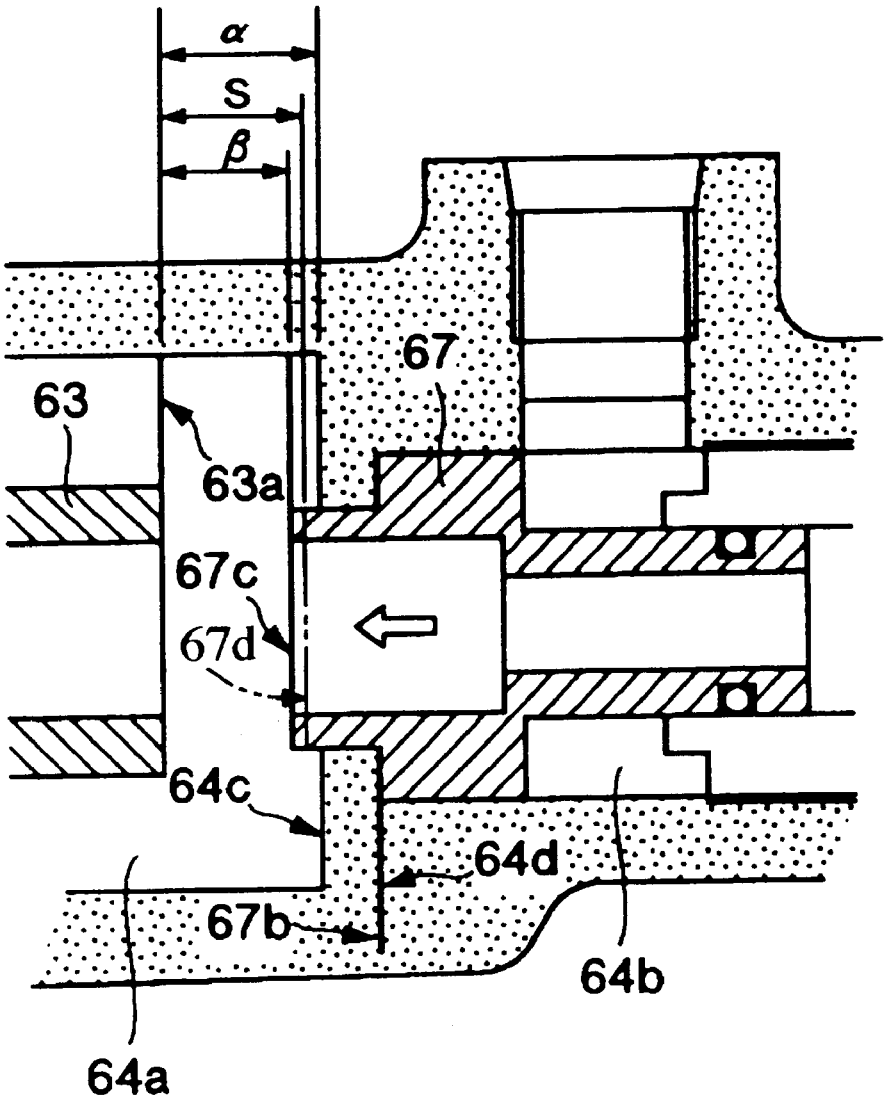
FIG. 3 is an enlarged view of a piston in FIG. 2.

A first embodiment of a control circuit in accordance with the invention is shown in FIGS. 1 to 3. Referring to FIG. 1, a boom actuator 32 (called the "first actuator 32") and an upper vehicle turning actuator 25 (called the "second actuator 25") constitute a parallel circuit. A hydraulic pump 1 is connected to a boom control valve 2 (called the "first control valve 2") via a conduit 4. The first control valve 2 communicates with the first actuator 32 via conduits 3A and 3B. The hydraulic pump 1 is connected to a upper vehicle turn control valve 5 (called the "second control valve 5") via a conduit 4*a* branching from the conduit 4. The second control valve 5 is connected to the second actuator 25 via conduits 6A and 6B.

A pilot valve 8*a,* activated in response to the operation of a boom operating lever 8, is connected to operation parts 2*a* and 2*b* of the first control valve 2 via an "upward" pilot conduit 11 and a "downward" pilot conduit 12, respectively.

A pilot valve 9*a,* operated in response to the operation of an upper vehicle turn lever 9, is connected to operation parts 5*a* and 5*b* of the second control valve 5 via a "left turn" pilot conduit 13 and a "right turn" pilot conduit 14, respectively. The pilot valves 8*a* and 9*a* are connected to a pilot pump 7 via a conduit 10.

In the pilot operation circuit constituted by the foregoing members, the operations of the boom operating lever 8 and the turn lever 9 enable the pilot pressures from the pilot pump 7 to be supplied to the conduits 11, 12, 13 and 14 via the conduit 10 and the pilot valves 8*a* and 9*a*. The pilot pressures act on either the operation part 2*a* (upward side) or the operation part 2*b* (downward side) of the first control valve 2, and either a second pilot port 66*a* of the operation part 5*a* (left turn side) of the second control valve 5 or a second pilot port 66*b* of the operation part 5*b* (right turn side) of the second control valve 5. Therefore, each of the first control valve 2 and the second control valve 5 can be operated so as to be switched from one of its positions to another of its positions.

A mode selector for regulating a stroke of a spool 61 (see FIG. 2) of the second control valve 5 will be described with reference to FIG. 1. The mode selector includes a mode selecting switch 16, a variable adjuster 17, a solenoid valve 18, and a controller 15. When the mode selecting switch 16 is turned ON and the variable adjuster 17 is set to a preset value, the controller 15 provides an operation part 18*a* of the solenoid valve 18 with a command signal for controlling an open area of the solenoid valve 18, in response to a signal from the variable adjuster 17. Therefore, the solenoid valve 18 is switched over to its position a, and opens. The open area of the solenoid valve 18 depends upon a value indicated by the signal from the variable adjuster 17, so that the pilot pressure from pilot valve 8*a* is adjusted on the basis of the open area of the solenoid valve 18.

Thereafter, the pilot pressure is supplied to the operation part 2*a* (upper side) of the first control valve 2 from the pilot valve 8*a* via the pilot conduit 11 when the operation lever 8 is manipulated to the "up" position. The pilot pressure also acts on the first pilot port 65*a* of the operation part 5*a* (left turn side) of the second control valve 5 and the first pilot port 65*b* of the operation part 5*b* (right turn side) of the second control valve 5. Therefore, for example, the operation part 5*a* of the second control valve 5 pushes the piston 67 to an extent, depending upon the pilot pressure, in the arrow direction shown in FIG. 2, thereby regulating the stroke of the spool 61 of the second control valve 5.

The structure for regulating the stroke of the spool 61 will be described hereinafter. The operation part 5*b* of the second control valve 5 is identical to the operation part 5*a,* and will not be described and shown. The spool 61 is slidably housed in a valve body 60, and includes springs 62 at its opposite ends. The springs 62 are balanced by an equal force in order to position the spool 61 at its predetermined location, and each spring is housed in a respective pilot chamber 64*a* of the pilot case 64, via a sleeve 63.

A plug 68, housed in the pilot case 64, is provided with a second pilot port 66*a* on which the pilot pressure for changing the stroke of the spool 61 acts. The pilot case 64 has a first pilot port 65*a* to which pilot pressure acting on the operation part 2*a* (upward side) of the first control valve 2 is supplied via the pilot conduit llb (see FIG. 1). The piston 67 has its large diameter portion slidably fitted in a piston chamber 64*b* of the pilot case 64, and its small diameter portion, containing an O-ring, slidably and sealingly fitted into the plug 68. Further, the piston 67 has, at its center, a through-hole 67*a* for enabling the pilot pressure to act on the pilot chamber 64*a* as well as on the second pilot port 66*a*.

When the pilot pressure acts on the first pilot port 65*a* in the foregoing arrangement, the piston 67 is moved in the direction of the arrow in FIG. 3. If the variable adjuster 17 has been set to the predetermined maximum value (i.e., the maximum pilot pressure), the piston 67 is pushed in the direction of the arrow until it is brought into contact with an annular side 64*d* of the piston chamber 64*b* via an annular radial wall 67*b* of the large diameter portion of the piston 67, as shown in FIG. 3. The space between the tip 63*a* of the sleeve 63, fixed to the end of the spool 61, and the tip 67*c* of the piston 67 becomes a minimum, i.e., $\beta$. Therefore, the spool 61 is designed to operate only by a stroke $\beta$, even when the pilot pressure acts on the second pilot port 66*b* of the operation part 5*b* (right turn side) shown in FIG. 1.

Conversely, when the mode selecting switch 16 remains inactive, the solenoid valve 18 (FIG. 1) is urged by a spring to stay at its position b, thereby blocking communication between the pilot conduits 11*a* and 11*b*. Since the piston 67 is not pushed, the space between the end 63*a* of the sleeve 63 and the side 64*c* of the pilot chamber 64*a* is $\alpha$ as shown in FIGS. 2 and 3. Therefore, the spool 61 is movable by the full stroke $\alpha$ when the pilot pressure acts on the second pilot port 66*b*.

Figure 5:
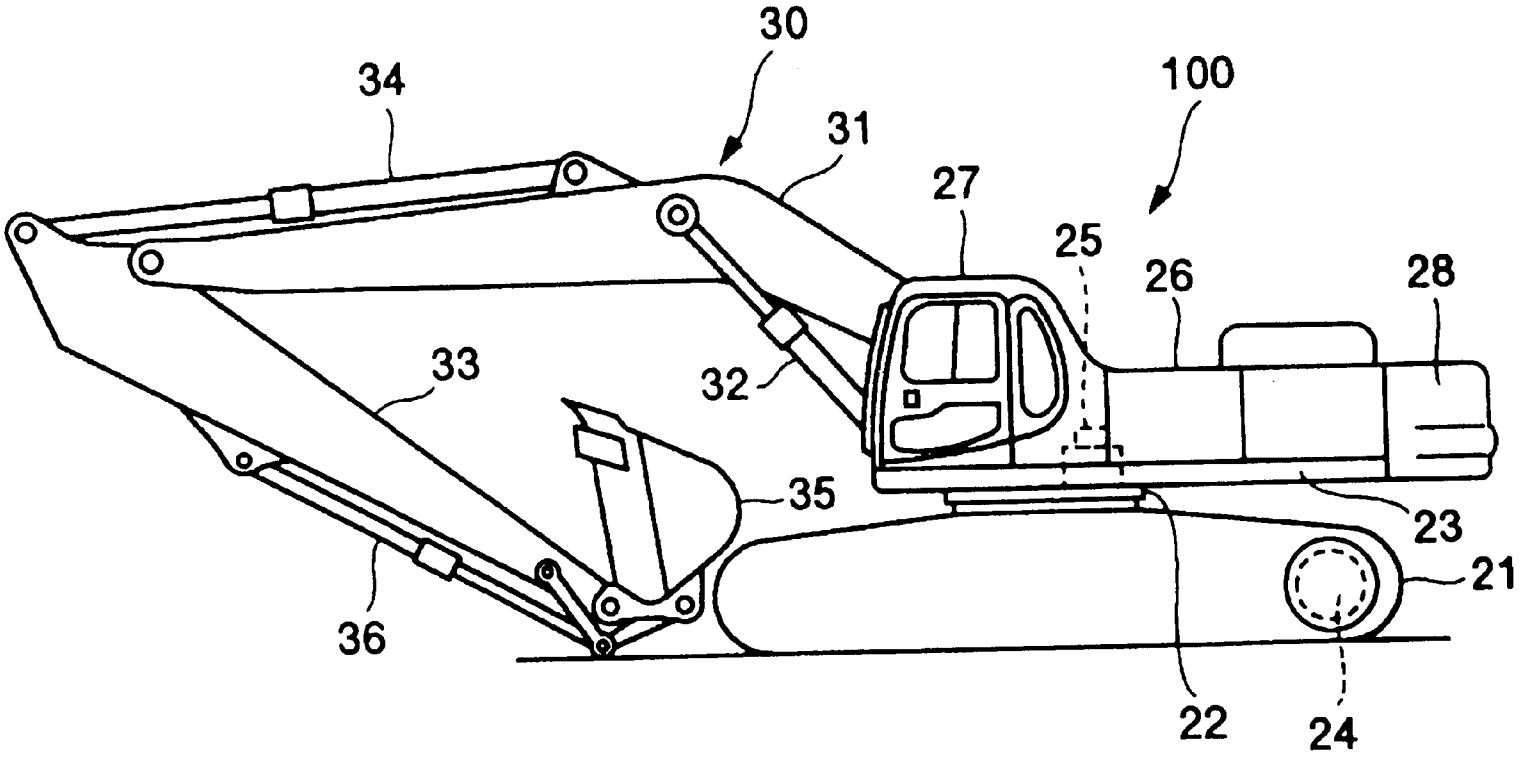
Fig. 5 Prior Art
FIG. 5 is a side view of a conventional hydraulic shovel.
Figure 6:
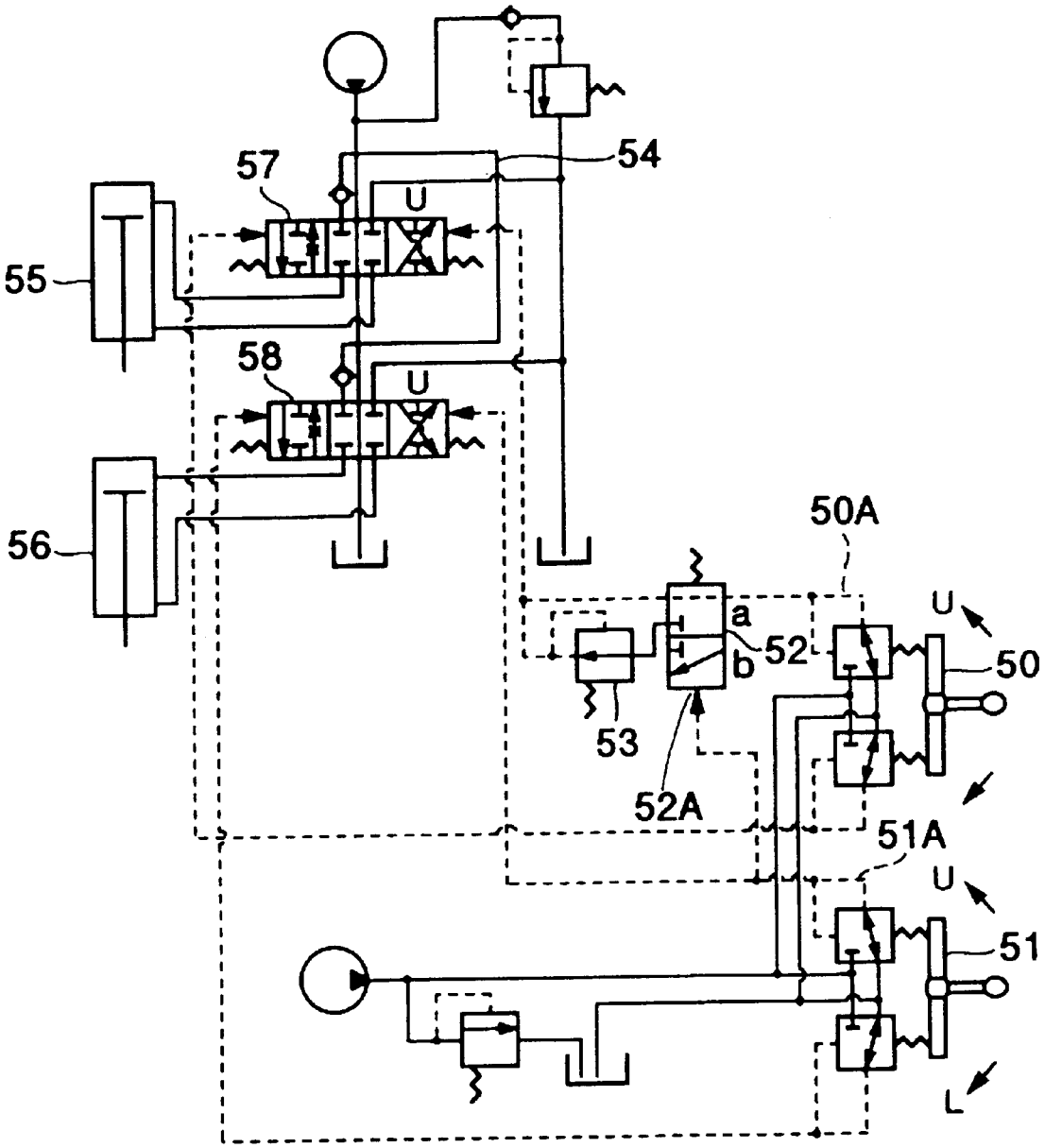
Fig. 6 Prior Art
FIG. 6 shows an example of a conventional control circuit for a hydraulic shovel.
Figure 7:
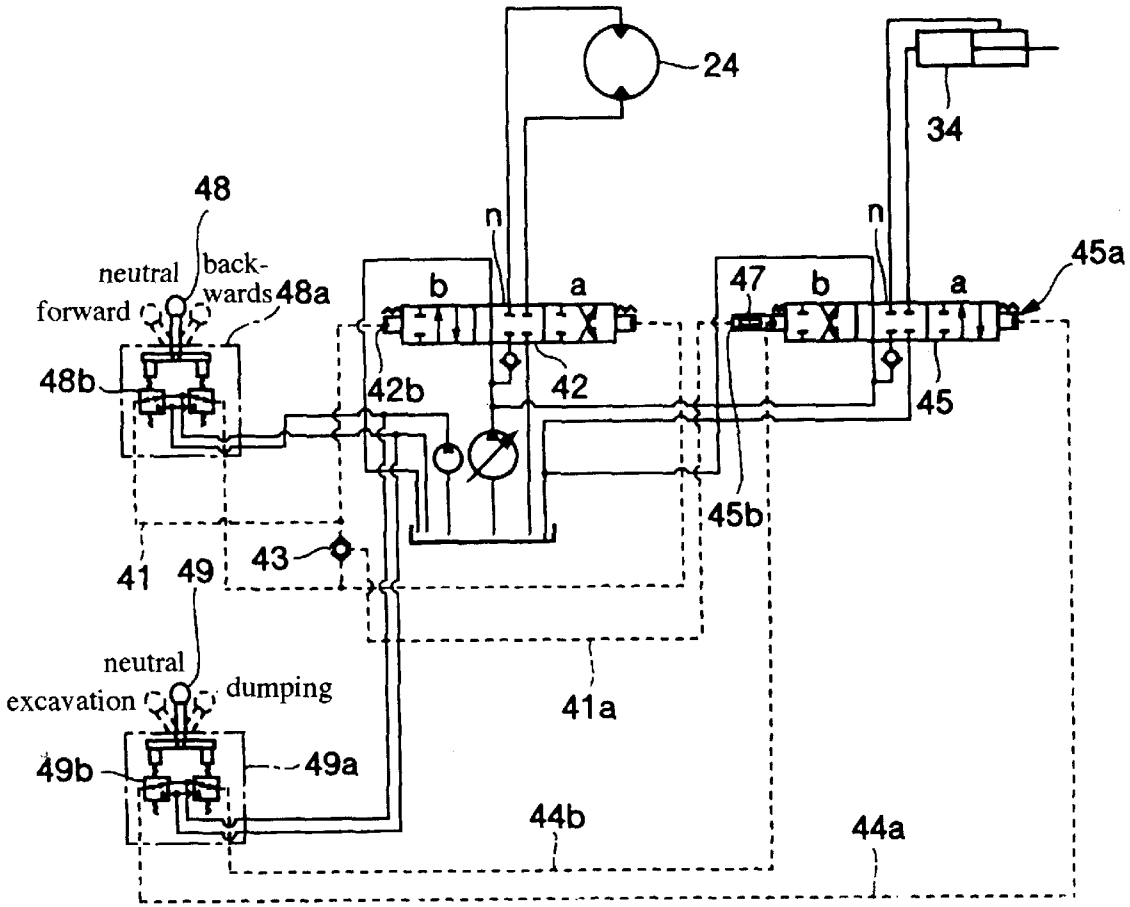
Fig. 7 Prior Art
FIG. 7 shows another example of a conventional control circuit for a hydraulic shovel.
Figure 8:
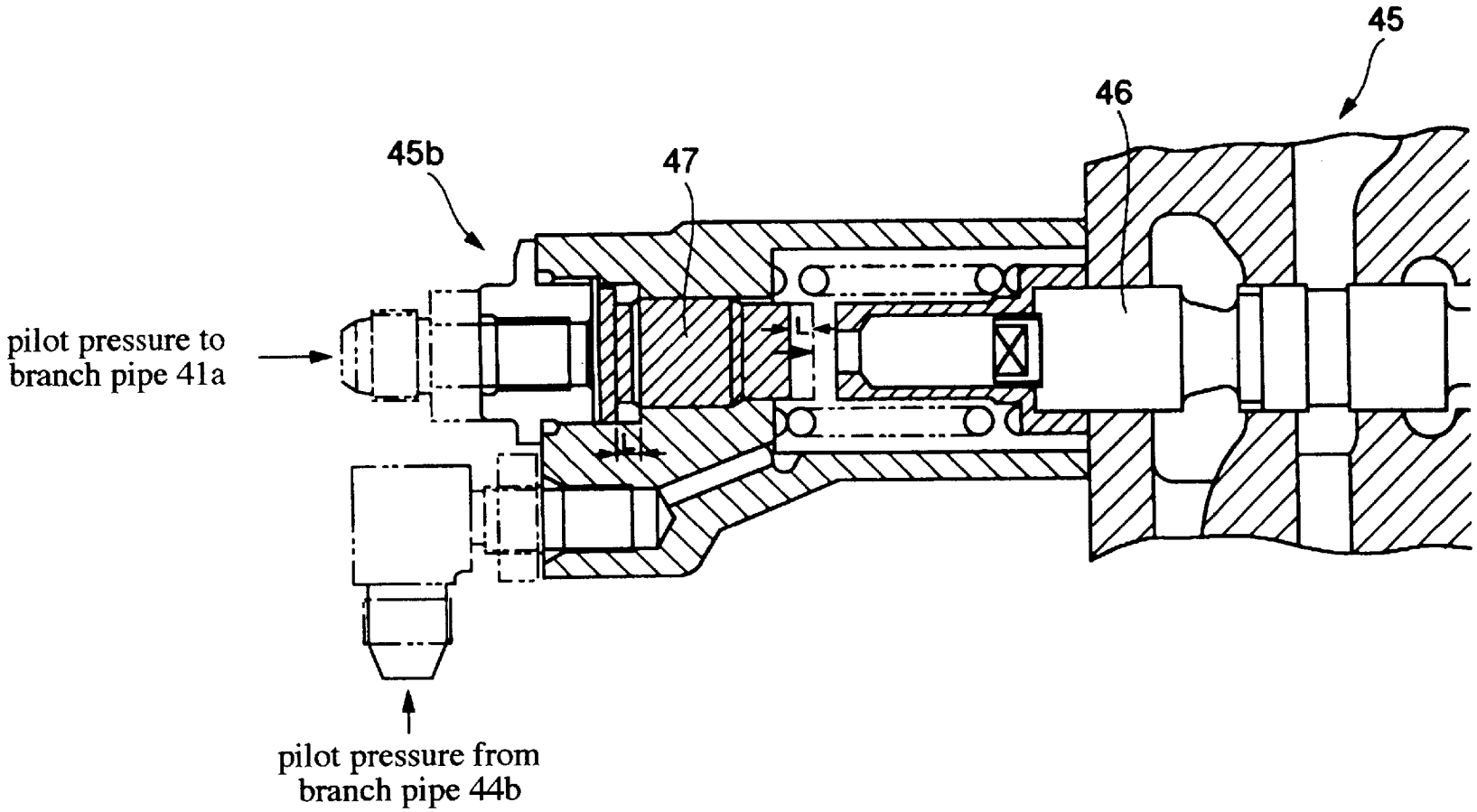
Fig. 8 Prior Art
FIG. 8 shows an operation part of an arm control valve in the control circuit of FIG. 7.

The operation of the control circuit shown in FIGS. 1 to 3 will be described hereinafter. When the boom operating lever 8 is set to the "up" position, the pilot pressure from the pilot pump 7 acts on the operation part 2*a* (upward side) of the first control valve 2 via the pilot conduit 11 and the reducing valve 8*b*, against a spring which continuously blocks an input port and an output port of the reducing valve 8*b* of the boom pilot valve 8*a*. As a result, the first control valve 2 is switched from its neutral position n over to its position a, so that the pressurized oil discharged from the hydraulic conduit 4 flows to a bottom side of the first actuator 32 via the conduit 4, the first control valve 2, and the conduit 3A, and the first actuator 32 extends to raise the boom 31 (shown in FIG. 5).

When the boom operating lever 8 is set to the "down" position, the pilot pressure from the pilot pump 7 acts on the operation part 2*b* (downward side) of the first control valve 2 via the boom pilot conduit 12 and the reducing valve 8*c*, against the spring which continuously blocks the input and output ports of the reducing valve 8*c* of the boom pilot valve 8*a*. Thereafter, the first control valve 2 is switched from its neutral position n over to its position b, so that pressurized oil from the hydraulic pump 1 flows into the head side of the first actuator 32 via the conduit 4, the first control valve 2, and the conduit 3B. The first actuator 32 is contracted, thereby enabling the boom 31 to perform the downward movement.

A pilot valve 9*a* of the turn lever 9 operates similarly to the pilot valve 8*a* of the boom operating lever 8. Specifically, when the turn lever 9 is set to either the left turn position or the right turn position, the pilot pressure from the reducing valve 9*b* or 9*c* of the pilot valve 9*a* acts on either the second pilot port 66*a* via the pilot conduit 13 or the second pilot port 66*b* via the pilot conduit 14. Therefore, the second control valve 5 is switched from its neutral position n over to its position a or b, so that the pressurized oil from the hydraulic pump 1 is supplied to a port F of the second actuator 25 via the conduit 4, the second control valve 5, and the conduit 6A, or to a port R of the second actuator 25 via the conduit 4, the branch conduit 4*a*, the second control valve 5, and the conduit 6B. As result, the actuator 25 rotates clockwise or counterclockwise, enabling the upper vehicle 23 (FIG. 5) to turn left or right.

In order to operate both the first actuator 32 and the second actuator 25 in combination, first of all, the motor selecting switch 16 is turned ON, and the variable adjuster 17 is set to the preset value. The solenoid valve 18 is then opened to an extent determined by the signal from the variable adjuster 17. Next, when the boom operating lever 8 is shifted to the "up" position, the pilot pressure, for switching the first control valve 2 over to one of its positions from its neutral position n, acts on the operation part 2*a* of the first control valve 2 via the pilot conduit 11. This pilot pressure also acts on not only the first pilot port 65*a* of the operation part 5*a* of the second control valve 5 but also on the second pilot port 65*b* of the operation part 5*b* of the second control valve 5 via the branch pilot conduit 11*a*, the solenoid valve 18, and the conduit 11*b*. Then, the pilot pressure further acts on the piston 67, which is made to move in the arrow direction to an extent in accordance with the pilot pressure.

In this state, the turn lever 9 is set to the left turn position or the right turn position in order to switch the second control valve 5 from its neutral position n over to its position a or b. It is assumed here that the pilot pressure is made to act on the second pilot port 66*a* or 66*b* via the pilot conduit 13 or 14. Since the piston 67 has already been moved in the direction of the arrow (FIG. 2), the spool 61 of the first control valve 5 operates only by the stroke S. This is because the space S is maintained between the end 63*a* of the sleeve 63 and the end 67*d* of the piston 67 when in its position as determined by the pilot pressure in ports 65*a* and 65*b* (FIG. 3). Here, $\beta \leqq S \leqq \alpha$. Therefore, the spool 61 is subject to the stroke regulation of $(\alpha-S)$, and has its open area reduced by the foregoing amount, so that the operation speed of the second actuator 25 is reduced. The spool 61 is subject to the stroke regulation of $(\alpha-\beta)$at maximum.

If only the second actuator 25 is operated or if the mode selecting switch 16 remains inactive, the piston 67 does not operate. In this state, when the pilot pressure acts on the second pilot port 66*a* or 66*b* via the pilot conduit 13 or 14 in order to switch the first control valve 5 from its neutral position n over to its position a or b, the spool 61 operates by the full stroke $\alpha$, and has its open area increased, which enables the second actuator 25 to operate at the predetermined speed.

According to this first embodiment, when both the first and second actuators 32 and 25 are operated in combination, the mode selecting switch 16 is turned ON, so that a reduced amount of pressurized oil is supplied to the second actuator 25 in order to enable the second actuator 25 to operate at a reduced speed. As a result, the upper vehicle turning and the boom lifting can be efficiently executed in combination at matched speeds, which is useful for heavy machinery performing a variety of jobs.

The variable adjuster 17 is effective in controlling the open area of the solenoid valve 18, and in enabling the stroke of the spool 61 of the second control valve 5 to be regulated as desired. Therefore, both the first actuator 32 and the second actuator 25 can be operated at the matched speeds by regulating the stroke of the spool 61 of the second control valve 5, depending upon the kinds of jobs to be executed by the heavy machinery. The control circuit of this embodiment is therefore useful to effect combined operation of components of the heavy machinery.

Figure 4:
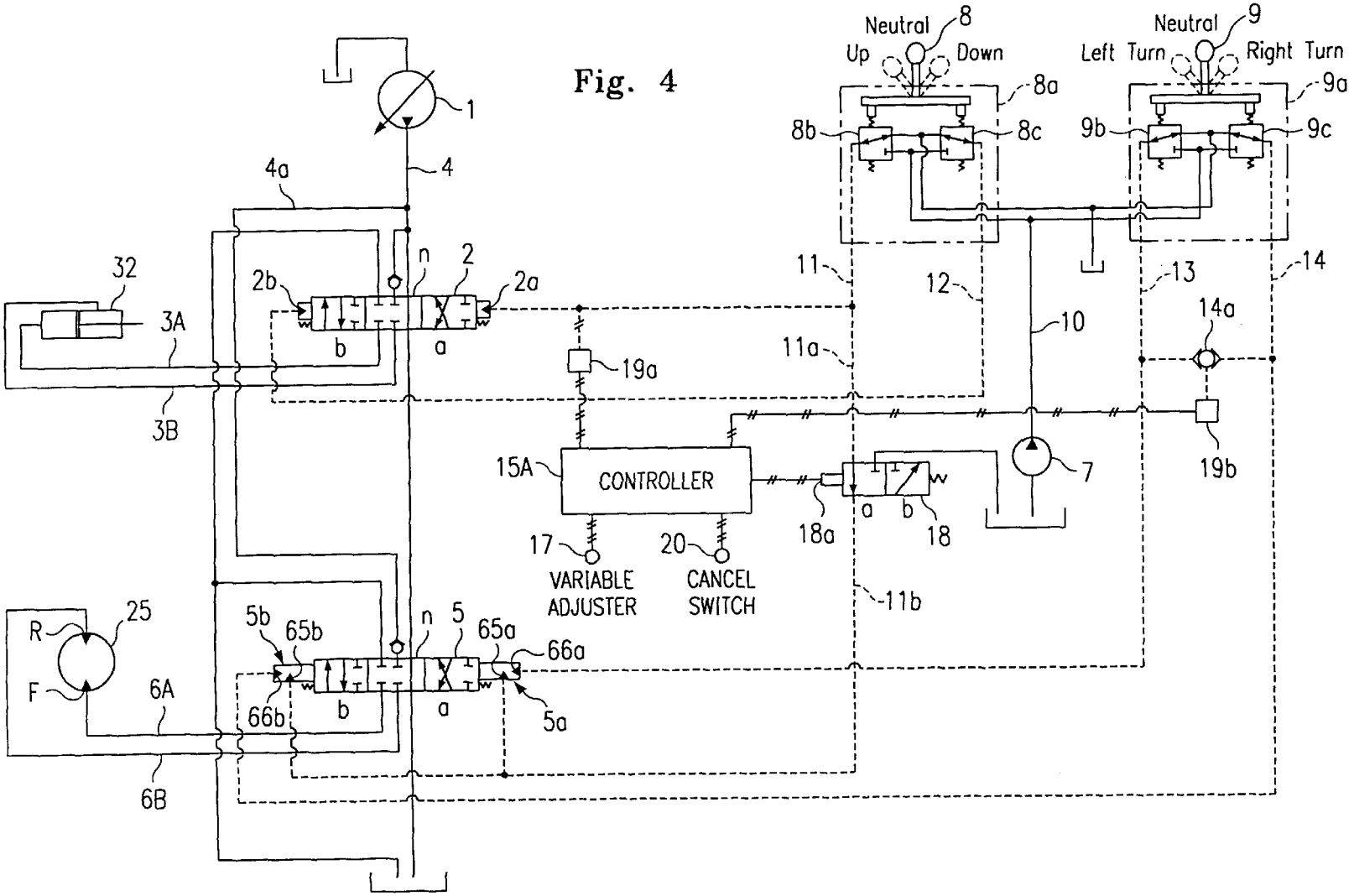
FIG. 4 shows a control circuit for heavy machinery, according to a second embodiment of the invention.

A second embodiment of the control circuit will be described with reference to FIGS. 2–4. This embodiment is substantially identical to the first embodiment except for the mode selector. Therefore, only the mode selector will be particularly described hereinafter.

The mode selector includes: a sensor 19*a* for detecting the pilot pressure applied to the operation part 2*a* (upward side) of the first control valve 2; a sensor 19*b* for detecting, via a shuttle valve 14*a,* the pilot pressure applied to the pilot port 66*a* of the operation part 5*a* (left turn side) of the second control valve 5 or the pilot pressure applied to the pilot port 66*b* (right turn side) of the operation part 5*b;* a solenoid valve 18; a variable adjuster 17; a cancel switch 20; and a controller 15A.

When the cancel switch 20 is turned OFF and the variable adjuster 17 is set to the preset value, the controller 15A prepares to provide an operation part 18*a* of the solenoid valve 18 with a command signal for controlling an open area of the solenoid valve 18 in response to the signal from the variable adjuster 17. In this state, the boom operating lever 8 is set to the "up" position, and the boom pilot pressure is supplied to the operation part 2*a* (upward side) of the first control valve 2 via the pilot valve 8*a*. The sensor 19*a* detects this boom pilot pressure, and the turn lever 9 is set to either the left turn position or the right turn position. The turn pilot pressure is then supplied to the second pilot port 66*a* of the operation part 5*a* via the turn pilot valve 9*a* or to the second pilot port 66*b* of the operation part 5*b*. The sensor 19*b* detects this turn pilot pressure via the shuttle valve 14*a*. When the sensors 19*a* and 19*b* detect the pilot pressures, respectively, the controller 15A provides the command signal to the operation part 18*a* of the solenoid valve 18.

In response to the command signal, the solenoid valve 18 is switched over to its position a and opens. The open area of the solenoid valve 18 depends upon the signal from the variable adjuster 17. When the solenoid valve 18 opens, the boom pilot pressure at the operation part 2*a* (upward side) acts on the second pilot port 65*a* of the operation part 5*a* (left turn side) and the second pilot port 65*b* of the operating part 5*b* (right turn side), via the pilot conduits 11 and 11*a,* the solenoid valve 18, and the conduit 11*b*. As a result, the piston 67 is pushed in the direction of the arrow only by an amount corresponding to the pilot pressure, thereby performing the stroke regulation for the spool 61.

When the cancel switch 20 is turned ON, the controller 15A does not provide any command signal to the operation part 18*a* of the solenoid valve 18. The solenoid valve 18 is urged to its position b by the spring, thereby blocking communication between the pilot conduits 11*a* and 11*b*. Therefore, no stroke regulation is performed for the spool 61.

In this second embodiment, when the first and second actuators 32 and 25 are operated in combination, the spool 61 of the second control valve 5 automatically undergoes the stroke regulation, which is effective in enhancing the combined operation of these actuators. However, the stroke regulation can be cancelled by the cancel switch 20. When no stroke regulation of the spool 61 is necessary for a current job, the operator is free to operate the cancel switch 20, depending upon his skill, in order to efficiently perform the job. When the mode selectors in the first and second embodiments are appropriately used in combination, the combined operation can be further promoted depending upon the job to be executed.

When the control circuit of the invention is applied to a hydraulic shovel, for example, the pilot pressure from the boom operating lever for raising the boom 31 is made to act on the operation parts 5*a* and 5*b* of the second control valve 5 at the time of the hoist and turn operation (i.e., to raise the boom 31 and turn the upper vehicle 23 simultaneously), thereby regulating the stroke of the spool 61 of the second control valve 5 in the second actuator 25 (turn actuator). The open area of the spool 61 is adjusted in accordance with the pilot pressure from the boom operating lever 8, so that the speed of the second actuator 25, receiving a lower load, is reduced. This promotes the combined operation of the first and second actuators 32 and 25. The cancellation of the stroke regulation of the spool 61 is added to efficiently promote quick operations, if necessary. Further, the invention is also applicable to control circuits of heavy machinery and manufacturing equipment other than hydraulic shovels in order to enable combined operation of a plurality of actuators.

What is claimed is:

1. A control circuit for a machine having a plurality of hydraulic actuators, said control circuit comprising:

a first hydraulic actuator;

a second hydraulic actuator;

a hydraulic pump;

a first control valve for supplying said first hydraulic actuator with pressurized oil discharged from said hydraulic pump;

a second control valve for supplying a second hydraulic actuator with pressurized oil from said hydraulic pump;

a pilot pump;

operating devices for receiving pilot pressure from said pilot pump and for actuating said first control valve and said second control valve; and a mode selector for selectively providing said second control valve with a command to operate the first actuator at an increased speed compared with a speed of said second actuator when the first actuator and the second actuator are operated simultaneously, wherein said mode selector comprises:

a first detector for detecting a pilot pressure for actuating said first control valve;

a second detector for detecting a pilot pressure for actuating said second control valve;

a solenoid valve connected to operation parts of said second control valve; and a controller for providing said solenoid valve with a command to reduce a stroke of a spool of said second control valve in response to said controller receiving signals from both said first and second detectors.

2. A control circuit in accordance with claim 6, wherein said machine includes a traveling carriage, an upper rotatable vehicle, and a boom pivotably mounted on said upper rotatable vehicle;

wherein said first hydraulic actuator is a hydraulic cylinder for operating said boom; and wherein said second hydraulic actuator is a hydraulic motor for turning said upper rotatable vehicle.

3. A control circuit in accordance with claim 1, further comprising a cancelling means for cancelling stroke regulation of said spool which would otherwise be executed for a combined operation of said first and second actuators.

4. A control circuit in accordance with claim 1, wherein said operating parts of said second control valve include:

a pilot case, provided with first pilot ports, for receiving the pilot pressure for actuating said first control valve, and second pilot ports, for receiving the pilot pressure for actuating the second control valve; and a piston, housed in said pilot case and being in contact with an end of said spool, said piston being pushed by the pilot pressure from the first control valve to regulate the stroke of said spool when said first and second actuators are operated simultaneously.

5. A control circuit in accordance with claim 4, further comprising a cancelling means for cancelling stroke regulation of said spool which would otherwise be executed for a combined operation of said first and second actuators.

* * * * *

UNITED STATES PATENT AND TRADEMARK OFFICE

CERTIFICATE OF CORRECTION

PATENT : 6,006,521

DATED : December 28, 1999

INVENTOR(S): Seiichi Fuchita et al.

It is certified that error appears in the above-identified patent and that said Letters Patent is hereby corrected as shown below:

On the Front Page [75] Inventors:, the first line, after "Fuchita,", delete "Katano,", and insert --Katano-Shi--.

On the Front Page [75] Inventors:, the second line, after "Teranaka,", delete "Yawata;", and insert --Yawata-Shi--.

On the Front Page [75] Inventors:, the fourth line, delete "Hirakata;", and insert --Hirakata-Shi;--.

On the Front Page [75] Inventors:, the fourth line, delete "Kyoto,", and insert --Tsuzuki-Gun--.

Column 10, line 59 (claim 2, line 1), delete "6,", and insert --1--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*